US005987284A

United States Patent [19]

Lewis

[11] Patent Number: 5,987,284

[45] Date of Patent: Nov. 16, 1999

[54] METHOD AND APPARATUS FOR REMOVING FLUID FROM THE SURFACE OF A LIQUID DEVELOPED IMAGE

[75] Inventor: Richard B. Lewis, Williamson, N.Y.

[73] Assignee: Xerox Corporation, Stamford, Conn.

[21] Appl. No.: 08/939,535

[22] Filed: Sep. 29, 1997

[51] Int. Cl.[6] ..... G03G 15/00

[52] U.S. Cl. ..... 399/249; 134/21; 430/97

[58] Field of Search ..... 399/249; 430/97, 430/125; 134/15, 16, 21

[56] References Cited

U.S. PATENT DOCUMENTS 5,047,808 9/1991 Landa et al. ..... 355/277

5,332,642 7/1994 Simms et al. ..... 430/125

5,352,558 10/1994 Simms et al. ..... 430/125

5,640,655 6/1997 Shoji ..... 39/249

*Primary Examiner*—Joan Pendegrass

*Attorney, Agent, or Firm*—Aditya Krishnan; Mark Costello

[57] ABSTRACT

A method and apparatus for improving the quality of an image that is developed by a liquid carrier is disclosed. The invention relates to image blotting and is directed to reducing disruptive forces on the wet image during blotting. The invention relates to the conditions under which liquid carrier is removed from the surface of an image supportable member.

15 Claims, 6 Drawing Sheets

METHOD AND APPARATUS FOR REMOVING FLUID FROM THE SURFACE OF A LIQUID DEVELOPED IMAGE

The present invention is directed to a method and apparatus for removing excess liquid from a liquid bearing member. More specifically, for removing excess carrier fluid from the surface of a liquid developed image by altering the angle at which the imaging member is brought in contact with an absorbent blotting member.

BACKGROUND OF THE INVENTION

Generally, the process of electrostatographic copying is initiated by exposing a light image of an original document to a substantially uniformly charged photoreceptive member. Exposing the charged photoreceptive member to a light image discharges its surface in areas which correspond to non-image areas in the original document while maintaining the charge in image areas. This selective discharging scheme results in the creation of an electrostatic latent image of the original document on the surface of the photoreceptive member. This latent image is developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a powder toner image on the photoreceptive member. Alternatively, liquid developer materials comprising a liquid carrier material having toner particles dispersed therein have been utilized. In a liquid developing process, the developer material is applied to the latent image with the toner particles being attracted toward the image areas to form a liquid image. Regardless of the type of developer material employed, the toner particles of the developed image are subsequently transferred from the photoreceptive member to a copy sheet, either directly or by way of an intermediate transfer member. Once on the copy sheet, the image may be permanently affixed to provide a "hard copy" reproduction of the original document or file. The photoreceptive member is then cleaned to remove any charge and/or residual developing material from its surface in preparation for subsequent imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, in contradistinction to the light lens generated image systems which develop toner on the charged areas, knows as CAD, or "write white" systems. The subject invention applies to both such systems.

The use of liquid developer materials in imaging processes and the art of developing electrostatographic latent images formed on a photoconductive surface with liquid developer materials are well known. Indeed, various types of liquid developing systems have heretofore been disclosed. Liquid developers have many advantages, and often produce images of higher quality than those formed using dry toners. For example, images developed with liquid developers can be made to adhere to paper without a fixing or fusing step, thereby eliminating a requirement to include a resin in the liquid developer for fusing purposes. In addition, the toner particles can be made to be very small without resulting in problems often associated with small particle powder toners, such as airborne contamination which can adversely affect machine reliability and can create potential health hazards. Development with liquid developers in full color imaging processes also has many advantages, including, among others, production of a texturally attractive output document due to minimal multi-layer toner height build-up (whereas full color images developed with dry toners often exhibit substantial height build-up of the image in regions where color areas overlap). In addition, full color imaging with liquid developers is economically attractive, particularly if surplus liquid carrier containing the toner particles can be economically recovered without cross contamination of colorants. Further, full color prints made with liquid developers can be processed to a substantially uniform finish, whereas uniformity of finish is difficult to achieve with powder toners due to a need for thermal fusion, in addition to variations in the toner pile height and other factors.

When using liquid toners, there is a need to remove the liquid carrier medium from the photoconductive surface after the toner has been applied thereto. This prevents the liquid carrier from being transferred from the photoreceptor to the paper or to the intermediate medium during image transfer. Removing the liquid carrier also allows it to be recovered for recycle and reuse in the developer system. This provides for additional cost savings in terms of printing supplies, and helps eliminate environmental and health concerns which result from disposal of excess liquid carrier medium. Furthermore, removing the liquid carrier increases the mechanical strength of the image which prevents it from being damaged during subsequent processing steps.

One way to remove excess carrier fluid is to place a blotting member in rotatable contact with the image while it resides on the photoreceptor or intermediate imaging member. A vacuum associated with the blotting member causes the liquid to be pulled from the photoreceptor surface. Removal of carrier fluid results in an increase in solid particle content, thereby allowing for greater efficiency of the process of transferring the image from the imaging member to permanent media. The most efficient conditioning of an image to increase the percentage of solids residing therein obviously requires preventing the solid toner particles from leaving the image while the carrier liquid is being removed. This process must be completed without disturbing the toner image.

Typical methods of removing excess fluid using a blotting member require passing the imaging member directly under the roll to absorb the contacting liquid carrier fluid. The strength of the vacuum associated with the roll is determined by the speed at which the imaging member moves past the roll. Specifically, faster process speeds require a higher vacuum to be applied to the image in order to remove a sufficient amount of fluid. Vacuum systems that are capable of supplying a sufficient amount of suction are often quite large and take up too much space within the printing machine. In addition, significant costs can be associated with purchasing and operating a high capacity vacuum system. Thus, it is advantageous to devise a system which can remove excess carrier fluid from the surface of an imaging member without requiring the application of a high vacuum.

The following disclosures may be relevant to various aspects of the present invention:

U.S. Pat. No. 5,332,642 to Simms et al. Issued Jul. 26, 1994 discloses a device for increasing the solids content of an image formed from liquid developer wherein absorption material is contacted with a liquid carrier laden image and the absorbed liquid carrier is vacuumed out of the absorption material. The absorption material preferably is a conductive cover on a porous roller biased with an electrical charge which is the same as the charge of the toner particles.

U.S. Pat. No. 5,352,558 to Simms et al. issued Oct. 4, 1994 discloses a device for increasing the solids content of an image formed from liquid developer which includes an absorption material containing small pores to absorb dispersant from a dispersant laden image and a pair of rollers bearing the belt. The belt on one of the rollers contacts a dispersant laden image bearing portion of an image carrying member such as a photoreceptor drum or an intermediate sheet U.S. Pat. No. 5,047,808 to Landa et. al issued Sep. 10, 1991 discloses an image system including an image bearing surface and an intermediate transfer member operative for transfer of liquid toner images from the image bearing surface to a substrate. The system provides for first transfer engagement between the intermediate transfer member and the image bearing surface for transfer of an image from the image bearing surface to the intermediate transfer member at a first pressure, and then provides for second transfer engagement between the intermediate transfer member and the substrate for transfer of the image from the intermediate transfer member to the substrate at a second pressure. Application of the first pressure produces deformation of the intermediate transfer member to a first deformation degree, while the second pressure application produces deformation of the intermediate transfer member to a second deformation degree.

All of the references cited herein are incorporated by reference for their teachings.

Accordingly, although known apparatus and processes are suitable for their intended purposes, a need remains for method and apparatus for reproducing images that have been developed using a liquid developer material.

Further, there is a need for methods and apparatus for removing excess carrier fluid from the surface of a liquid developed image, to allow for a more efficient system of reproducing these types of images.

SUMMARY OF THE INVENTION

In accordance with one aspect of the invention there is provided an apparatus for removing excess liquid from a liquid bearing member, which includes: a blotting member placed in relative motion with respect to the liquid bearing member, the blotting member having an interior core surrounded by a conformable, porous exterior surface, the interior core being under a vacuum, the vacuum having a level that is lower than a capillary pressure of the porous exterior surface; at least one guide which brings the liquid bearing member and the blotting member into conformable contact under a force primarily applied by the interior core vacuum, thereby forming a contacting region in relative motion to the blotting member; and a securing device which maintains the liquid bearing member and the blotting member in non-sliding relationship to cause liquid to be drawn from the liquid bearing member and absorbed by the blotting member, wherein the liquid borne by the liquid bearing member includes a xerographic image that has been developed by solid toner particles immersed in a liquid carrier medium.

In accordance with another aspect of the invention there is provided a method of removing excess liquid from a liquid bearing member, which includes: bringing the liquid bearing member into conformable contact with a blotting member, the blotting member having an interior core surrounded by a conformable, porous exterior surface, the interior core being under a vacuum having a level lower than a capillary pressure of the porous exterior surface, wherein the liquid bearing member and the blotting member are brought into conformable contact under a force primarily applied by the interior core vacuum to form a contacting region; and maintaining the liquid bearing member and the blotting member in non-sliding relationship, thereby causing liquid to be drawn from the liquid bearing member and absorbed by the blotting member, wherein the liquid borne by the liquid bearing member includes a xerographic image that has been developed by solid toner particles immersed in a liquid carrier medium.

In accordance with yet another aspect of the invention, there is provided an apparatus for removing excess liquid from a liquid-developed electrostatographic image which includes: an image bearing member which supports the developed electrostatographic image and transports it along a path in a process direction; a blotting member having a conformable, porous face and having a vacuum level below a capillary pressure of the porous face; means for guiding the image bearing member and the blotting member into face to face contact throughout a length while preventing forces other than the vacuum blotter forces to be applied to the electrostatographic image; and means for maintaining the image bearing member and the blotting member in non-sliding relationship for a time period sufficient to remove excess liquid from the image, thereby strengthening the electrostatographic image without disturbing it.

The present invention has significant advantages over current methods and apparatus for high speed reproduction of liquid developed images. First, it allows a smaller vacuum pump to be associated with the blotter roll system. This provides significant savings in cost, particularly in the purchase of required hardware. In addition, the present invention allows the speed at which these images can be reproduced to be dramatically increased.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

The present invention is directed to a method and apparatus for improving the quality of an image developed by a liquid carrier. More specifically, the present invention is directed to removing excess carrier fluid from the surface of a liquid developer image by altering the angle at which the blotter roll contacts the surface of an imaging member.

Figure 1:
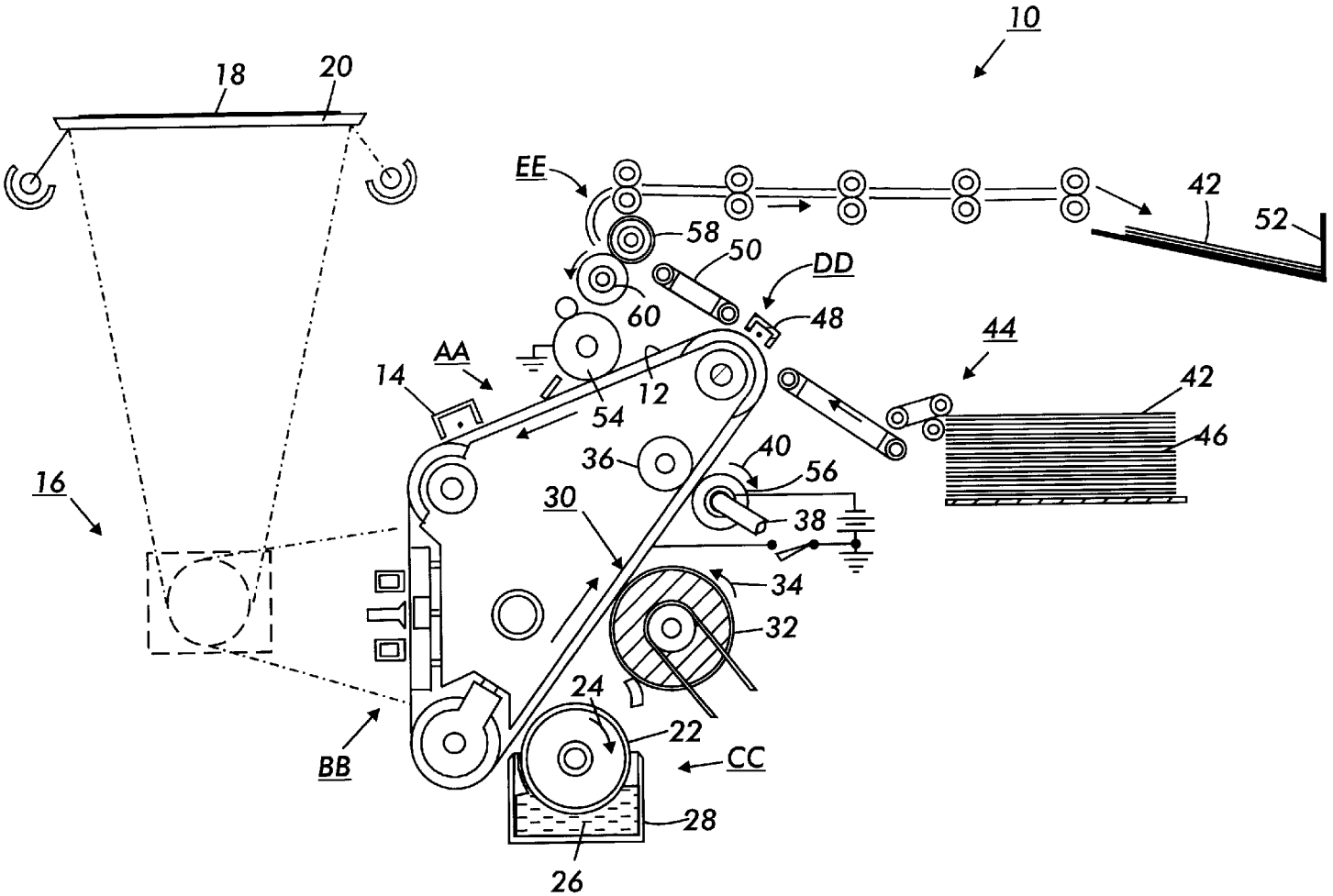
FIG. 1 is a schematic elevation view depicting an electrophotographic reproduction machine which uses a liquid image development system.

Referring now to the drawings where the showings are for the purpose of describing an embodiment of the invention and not for limiting same, FIG. 1 shows a reproduction machine 10 having a liquid image bearing member 12 with a photoconductive surface deposited on a conductive substrate. Liquid image bearing member 12 supports an image as it moves along a path for passage through one or more stations. Initially, liquid image bearing member 12 passes through charging station AA. At charging station AA, a corona generating device 14 charges the photoconductive surface of the image bearing member to a relatively high, substantially uniform potential.

Once the photoconductive surface of liquid image bearing member 12 is charged, the charged portion is advanced to exposure station BB. At exposure station BB, an illumination assembly, indicated generally by the reference numeral 16, illuminates original document 18, which has previously been placed on platen 20. Illumination of original document 18 produces image rays corresponding to the document information areas, which are then projected by means of an optical system onto the charged portion of the photoconductive surface. The light image dissipates the charge in selected areas to record an electrostatic latent image on the photoconductive surface corresponding to the original document informational areas.

Still referring to FIG. 1, liquid image bearing member 12 transports the electrostatic latent image to development station CC, where roller 22, rotating in the direction of arrow 24, advances a liquid developer material 26 from the chamber of housing 28 to development zone 30. Metering roller 32, placed downstream from roller 22 then contacts the developed image, rotating in the direction opposite that of roller 22 as indicated by arrow 34, to remove excess carrier fluid from the surface of the image. Metering roller 32 is typically biased between the voltages of the image areas and the non-image areas of the electrostatic latent image to allow roller 32 to reduce the thickness of the liquid carrier on the photoconductive surface, and remove toner from non-image areas.

The developed liquid image next encounters an image conditioning roller 56, which is supported by backup roller 36 placed in pressure contact therewith, and located on the opposite side of belt 12. Roller 56 is brought in contact with the developed image to condition it, which includes reducing its liquid content, while inhibiting and preventing the movement of solid toner particles therefrom. The roller 56 also conditions the image by electrostatically compacting the toner particles. This results in an increase in the percentage of solid particles remaining in the developed image, thereby improving the quality of the reproduced copy.

With continued reference to FIG. 1, backup roller 36 is typically placed in pressure contact against roller 56, and is often used in conjunction with a vacuum system 38 to squeeze the absorbed carrier liquid from roller 56 for deposit into a receptacle. An electrical potential is applied to roller 56 from a high voltage bias supply, and the electric field, which has the same sign polarity as the toner particles, repels the toner particles of the image and inhibits their entry to the roller 56.

In operation, roller 56 rotates in direction 40 to encounter a "wet" image on belt 12. The body of roller 56 absorbs excess liquid from the surface of the image, while conditioning the image on belt 12. Vacuum system 38 located on one end of a central cavity of 214 of roller 56 (best illustrated in FIG. 3), draws liquid that has permeated through roller 56 out through the cavity and deposits it in a receptacle or some other location which will allow for either disposal or recirculation of the carrier liquid. Roller 56, discharged of excess liquid, continues to rotate in direction 40 to provide a continuous absorption of liquid from the image on belt 12.

Still referring to FIG. 1, the developed electrostatic latent image is advanced to transfer station DD, where copy sheet 42 is advanced from stack 46 by a sheet transport mechanism, indicated generally by the reference numeral 44. Transfer station DD includes a corona generating device 48 which sprays ions onto the backside of the copy sheet 42. This attracts the developed image from the photoconductive surface of liquid image bearing member 12 to copy sheet 42.

Conveyor belt 50 of the apparatus of FIG. 1 next advances the transferred image to fusing station EE. Fusing station EE includes a fuser assembly which permanently fuses the developed image to the copy sheet 42. The fuser assembly of FIG. 1 includes a heated fuser roll 58 and backup pressure roll 60 resiliently urged into engagement with one another to form a nip through which the copy sheet 42 passes. After fusing, the finished copy sheet 42 is discharged to output tray 52 for removal by the machine operator.

Figure 2:
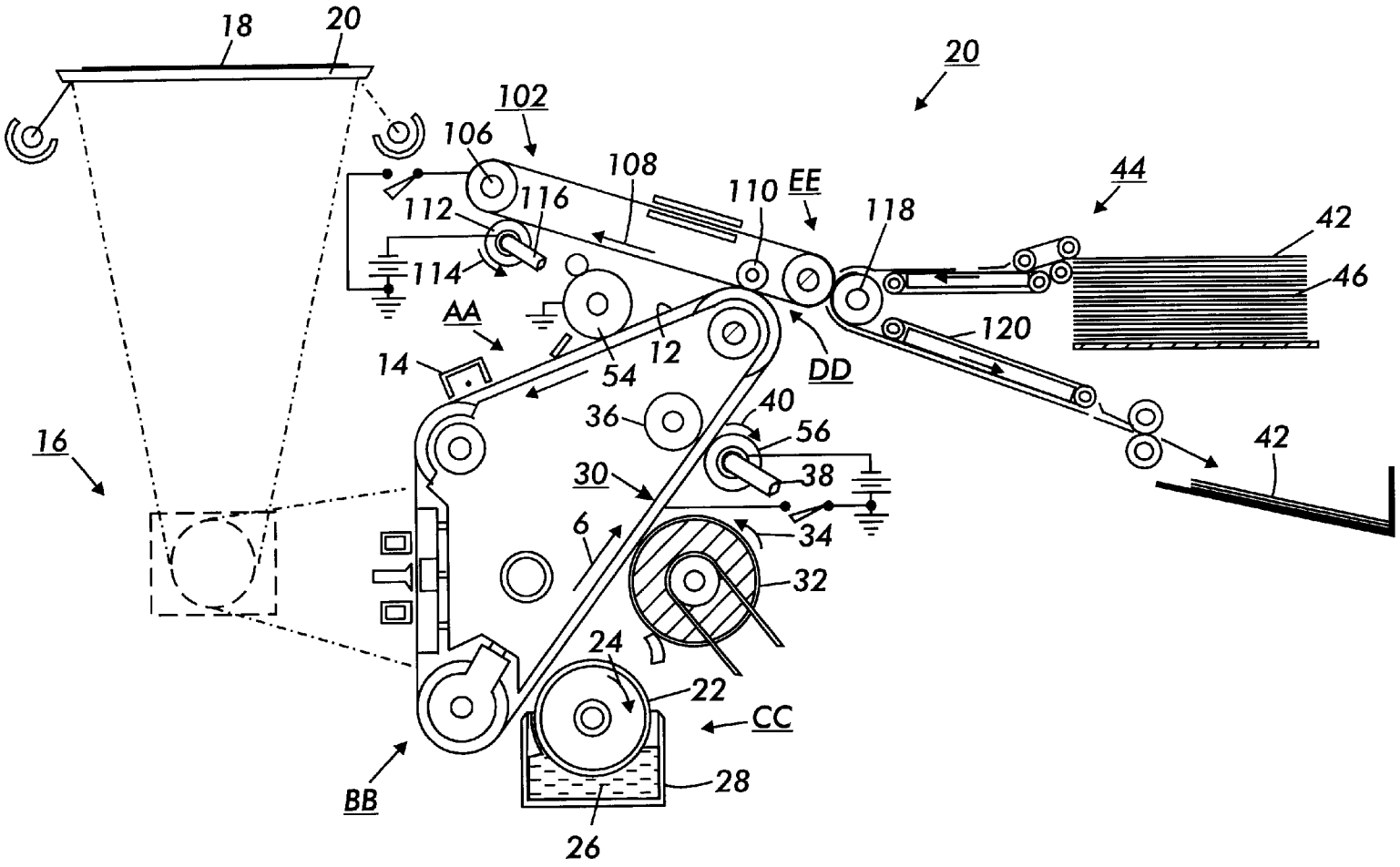
FIG. 2 is a schematic elevation view depicting an electrophotographic reproduction machine which uses an intermediate transfer belt in conjunction with a liquid image development system.

In the alternative, the invention may be embodied in a printing machine such as the one depicted in FIG. 2 (elements of FIG. 2 that are identical to elements in FIG. 1 are identified with like reference numerals and will not be described again here). This embodiment of the invention employs a moving image carrying belt, from which an image is transferred to an intermediate belt 102. In this case, both the moving image carrying belt and intermediate belt 102 are image transportable members as discussed above. The developed liquid image is electrostatically transferred to an intermediate member or belt 102 rather than to fusing station EE, after being advanced through transfer station DD.

An additional conditioning device shown as blotting member 112, may be used to further condition the developed image on belt 102 by electrostatically compressing it, and additionally reducing the liquid content of the image, while preventing toner particles from being removed. Although the apparatus shown here shows only a single blotting member 112, multiple blotting member stations can be utilized in conjunction with a single belt or with the transfer of multiple images to an intermediate belt 102. Such an arrangement might be used for example, in a printing machine that is capable of reproducing color images. Those of ordinary skill in the art will recognize that blotting member 112 may be a roller as shown in the illustration of FIG. 2, or it may be a flexible belt or other equivalent apparatus.

In operation, roller 112 rotates in direction 114 to impose against the image on belt 102. The body of roller 112 absorbs liquid from the surface of the image. The absorbed liquid permeates through roller 112 and into an inner hollow cavity (not shown), where a second vacuum system 116 draws the liquid from the roller 112 into a receptacle or liquid recirculation device. In a manner similar to that of roller 56, roller 112, discharged of excess liquid, continues to rotate in direction 114 to provide a continuous absorption of liquid from images on transfer belt 102.

Belt 102 next advances the image to station EE described above where it is simultaneously heated and fused to paper by heat from roller 104. After fusing, the finished copy sheet 42 is discharged to output tray 52 for removal by the machine operator.

Once the developed image has been transferred residual liquid developer material remains adhering to the photoconductive surface of belt 12. A cleaning roller 54 formed of any appropriate synthetic resin, is driven in a direction opposite to the direction of movement of liquid image bearing member 12 to scrub the photoconductive surface clean. A number of such photoconductor cleaning means exist in the art, any of which would be suitable for use with the present invention. Any residual charge left on the photoconductive surface can be extinguished by flooding the photoconductive surface with light.

Figure 3:
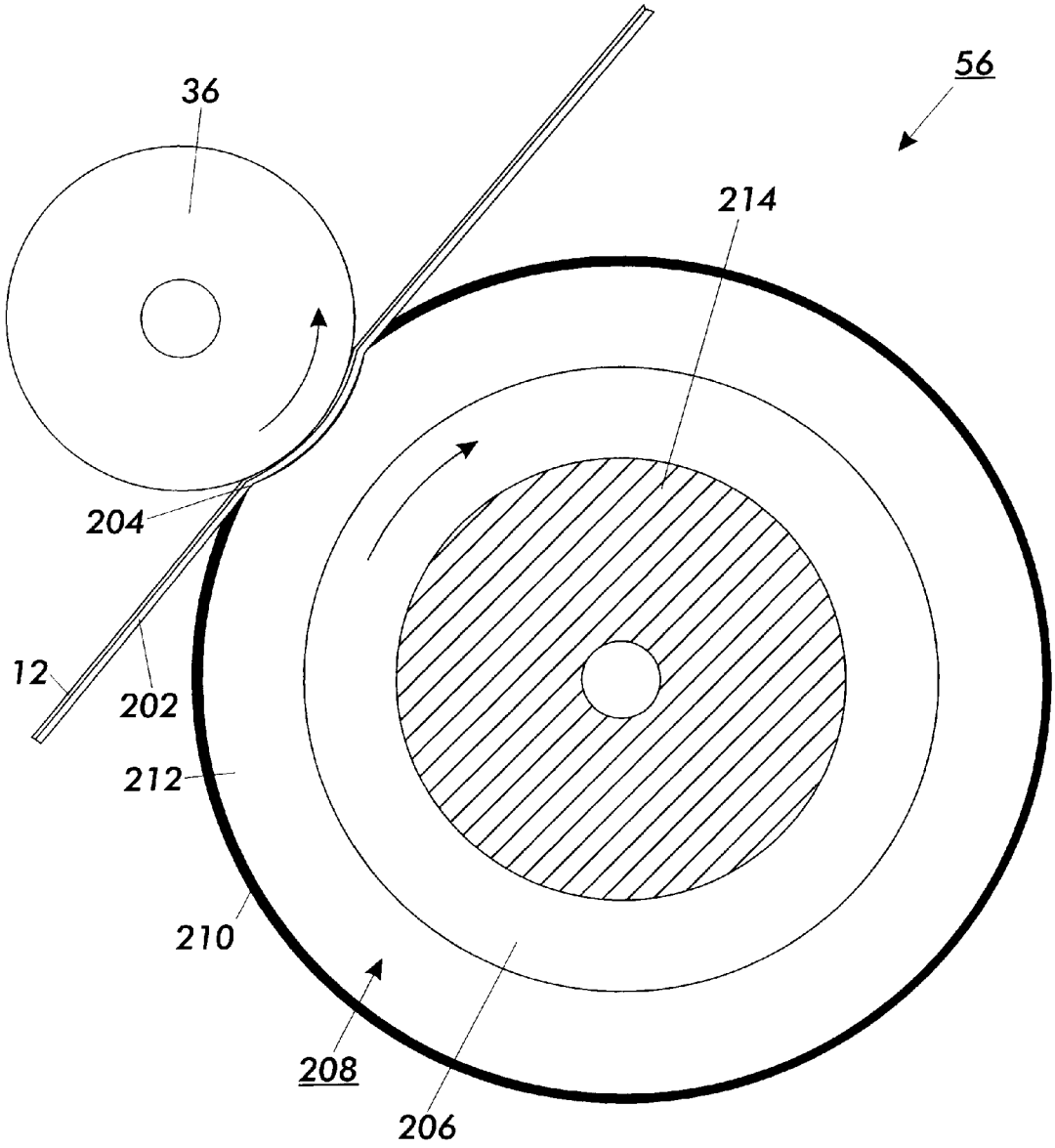
FIG. 3 (Related Art)
FIG. 3 contains a close up view of a blotter roll in contact with a substrate which is supporting a liquid developed image.

FIG. 3 contains a close up view of a liquid carrier removal system presently available in the art, which may be used with the printing machine illustrated in FIG. 1. Liquid image bearing member 12 transports the liquid image 202, bringing it in contact with blotting member 56. As the blotting member 56 contacts the liquid image, the excess liquid carrier is absorbed through its surface over the length of the area 204 where the image lies in contact with the exterior surface of blotting member 56 (the thickness of the liquid image has been exaggerated for clarity). In one embodiment, blotting member 56 includes a rigid, porous, hollow core 206 bearing on its outer surface a resilient, porous overlayer 208. Preferably the overlayer comprises a smooth, thin, small pore skin 210 disposed over a more coarse pore open cell foam 212, causing the entire roll to behave as a fluid filter with permeability determined by the skin.

While not absolutely necessary, the blotting member should be electrically conductive and biased to repel toner particles away from its center, toward the image-bearing member. A vacuum pump (not shown) is connected to the central cavity 214 of roll 56, and a pressure lower than that of the capillary pressure of porous overlayer 208 is applied thereto. This condition prevents air from entering the blotting member, while any bulk liquid carrier touching the skin is drawn inward until its air interface coincides with the skin, at which point the forces of surface tension stop fluid motion. Applying these pressures in the relative manner explained here prevents air from entering the roll and causes liquid carrier fluid from the image being brought in contact with the skin 210 of blotting member 56 to be drawn into central cavity 214. Keeping the vacuum below capillary pressure also avoids burdening the vacuum means with large volumes of ingested air.

Still referring to FIG. 3, the blotting member skin functions as a fluid filter with an area equal in size to that of contact area 204 where the liquid carrier rich toner layer contacts the skin on the surface of blotting member 56. This is because the capillary pressure condition only allows fluid to flow in locations on skin 208 that are flooded with bulk liquid carrier. Commonly, the liquid image from metering roll 32 is only about 100 microns in thickness which causes contact area 204 to extend only about 200 to 400 microns in the process direction. The geometry of contact area 204 is limited based upon the magnitude of forces which are externally applied to the image. These externally applied forces are large compared to those which can typically be sustained by a liquid image. Such external forces are typically applied by backup rolls and belt tension.

As with any filter there is a maximum capacity of fluid volume flow per unit skin area at which liquid carrier can be pulled into the blotting member. If this maximum capacity is exceeded, liquid carrier cannot flow in a smooth and unbroken manner through the blotting member surface but must instead flow turbulently, causing a relatively large pool of fluid to collect at the point where fluid contacts the surface of blotting member 56. While this larger pool increases the effective filter area, and so allows the necessary increase in total flow, such turbulent flow is very undesirable because it tends to disturb the still fragile, liquid carrier-laden image.

Several problems arise when attempts are made to design a blotting member that will effectively and efficiently remove excess fluid from the surface of an image that has been developed using a liquid carrier. Notably, the capacity of fluid flow through the roll is at least partially dependent upon the size of the pores present therein, and the level of the vacuum being applied to the system. On one hand, preventing clogging of toner particles at the blotting member surface requires that the size of the pores contained in the outer surface of the blotter roll be kept well below the diameter of the toner particles in the image. However, simply manufacturing a blotting member with pores this small is not a proper solution to this problem because smaller pores in the outer surface of the roll reduce the amount of fluid that can flow into and through the roll in any given period of time. Also, decreasing the level of vacuum that is applied to the roll allows a low energy, low cost vacuum to be supplied with the system. Unfortunately, application of a lower vacuum also reduces the volume of fluid that flows through the system in a given amount of time. Allowing these decreases in fluid removal rate can be detrimental to the design of a reproduction machine because high process speeds, generally desirable for productivity, require increased rates of liquid carrier removal. Thus, prior art methods either allow excess liquid to pool into a larger contact area, and risk damaging the image, or else suffer disadvantaged combinations of pore size, vacuum level, and process speed. These allowances must be made as a direct result of the very small contact area 204 where the liquid carrier rich toner layer meets the surface of blotting member 56.

Figure 4:
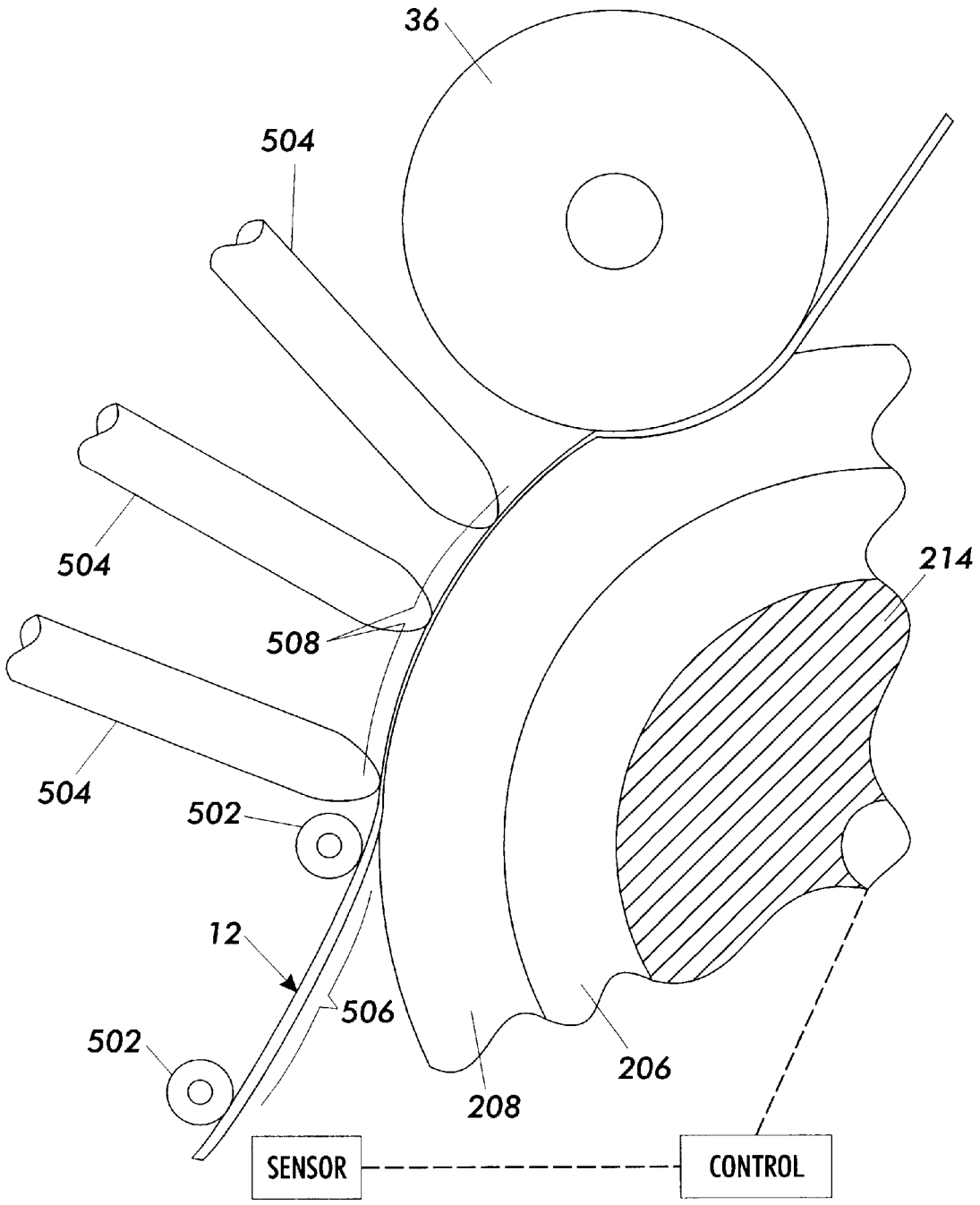
FIG. 4 contains a detailed illustration a liquid removal system of the present invention.

Turning now to FIG. 4, a liquid removal system that has been altered to include the present invention will now be described. In one embodiment, the liquid removal system of the present invention includes a blotting member 56 made from a interior core 206 surrounded by a conformable, porous exterior overlayer 208. In the preferred embodiment the interior core 206 is under a vacuum that is lower than the capillary pressure of the surrounding porous exterior surface. The system also includes one or more guides 502 which bring liquid image bearing member 12 and blotting member 56 into conformable contact under a force primarily applied by vacuum within interior core 206, to form a contacting region 508. As shown in the illustration, the invention allows contacting region 508 to cover an area and distance that is substantially larger than that of the prior art contacting area 204.

Blotting member 56 is typically placed at the end of the path through which liquid image bearing member 12 moves as it transports the latent image through the various xerographic stations, in a direction normal to the motion of the imaging member. In one embodiment, blotting member 56 rotates about its central axis, as liquid image bearing member 12 is brought into contact with the roller. However, many other configurations are possible, and blotting member 56 may remain stationary or move in a manner that does not include rotation as it is brought in contact with liquid imaging member 12. In any event, contacting regions 508 are created as liquid image bearing member 12 and blotting member 56 are in relative motion,which allows them to be brought together.

The presence of contacting regions 508 allows liquid bearing member 12 to be secured to blotting member 56 in non-sliding relationship. Most importantly, contacting regions 508 allow liquid imaging member 12 to be tightly pressed against blotting member 56 without applying forces other than those due to the vacuum pressure of blotter roll 56 directly to liquid image 202. The application of only the blotter roll forces to the image for the period of time that liquid image bearing member 12 is in contact with blotter roll 56 allows excess fluid to be removed from the surface of the image without disturbing it. In the described embodiment of the invention, liquid image bearing member 12 is in the form of a flexible belt, while blotting member 56 is made from a rigid, absorbent surface. However, it should be noted that either liquid bearing member 12 or blotting member 56, or both members may flexible. Further, when both members are flexible, the invention does not require them to be made from the same flexible material.

Liquid image bearing member 12 approaches blotting member 56 along a path preferably through a slack region 506, which may be maintained by any device capable of providing slack in the image bearing member. Such a slack provider may include optical, electronic or mechanical sensors readily available for such purposes, and may include mechanical means such as support pins and/or rollers, and similar devices known in the art that are capable of varying the amount of tension in the flexible member. The slack provider will typically be located in close proximity to the contacting region 508 to provide a slack region in the flexible liquid image bearing member 12 and/or blotting member 56, in order to maintain contacting region 508.

Still referring to FIG. 4, in another embodiment of the invention the slack provider includes a position sensor which senses the length of the slack region measured in the process direction, and a driving device which varies the speed differential between the liquid bearing member and the blotting member while the contacting region is being formed. Again, the sensors used for this purpose may be optical, electronic or mechanical sensors available in the art and capable of being incorporated in the present invention. The slack provider should also include a feedback system which links the position sensor to the adjustable driving device in order to continuously maintain the appropriate size of the slack region. Those of ordinary skill in the art will recognize that numerous feedback methods can be used for this purpose including, but not limited to a closed loop feedback system.

Again, the present invention causes the contacting forces to be applied to liquid image bearing member 12 in locations that are outside the perimeter of the developed liquid image 202 image, while preventing the application of these forces within the image perimeter. Once the proper amount of slack is provided in either or both of the flexible members, the image-bearing member can then be draped over the blotting member rather than pressed or drawn taut against it, thereby eliminating the large, externally applied normal force that is present between the image on liquid image bearing member 12 and blotting member 56 in prior art systems. In the present invention, the only forces being applied to the surface of the image as it contacts blotter roll 56 are those due to the vacuum pressure of the roll.

At the beginning of their joined motion liquid image bearing member 12 and the surface of blotting member 56 may be held together only by the surface tension of the liquid carrier and by a fraction of the vacuum level applied to central cavity 214 of the blotting member. As the volume of the image is reduced by removal of liquid carrier, the image-bearing member will drift toward the blotter surface. The present invention increases the effective filter length from the small contacting area 204 illustrated in FIG. 3, to a substantial fraction of the circumference of the blotting member 56, as illustrated by contacting region 508, illustrated in FIG. 4. Thus, the invention overcomes the limitations of prior art methods, by substantially increasing the contacting portion between the surface of blotting member 56 and liquid image bearing member 12. In one embodiment of the invention, the contacting portion was shown to increase by a factor greater than 100.

Figure 5:
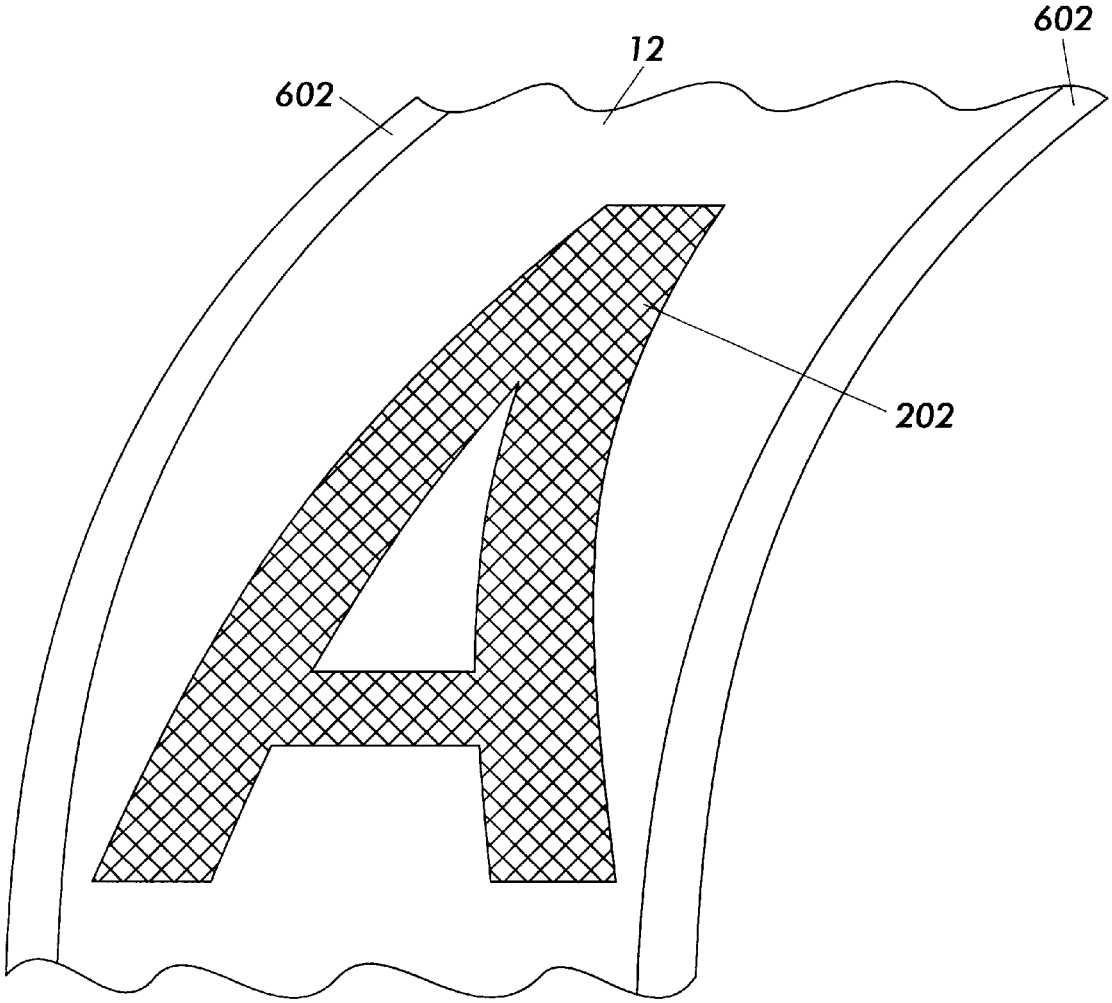
FIG. 5 contains a detailed view of an imaging member illustrating "vacuum hold down zones," one embodiment of the securing device included with the present the invention.

Referring now to FIG. 5 the force which holds liquid image bearing member 12 and the surface of blotting member 56 together must be kept low to avoid compressing the image and causing distortion. The small forces provided in the invention, and the fact that they are exerted in the normal direction, rather than in the plane of the image, create a risk of sliding or relative shear between the imaging member and the blotting member surface. For this reason, the present invention includes a securing device which maintains the liquid bearing member and the blotting member in non-sliding relationship to further assist in rapid removal of liquid from the surface of liquid bearing member 12 for absorption by blotting member 56. The securing device will be located in at least the contacting region 508, and may or may not extend in either. For that matter, while it is advantageous to secure the entire contacting region 508, it is possible to operate the invention with liquid image bearing member 12 being secured to blotting member 56 through less than the entire contacting region 508. The securing device will be transported along with contacting region 508 as liquid image bearing member 12 is brought toward and away from blotting member 56.

With continued reference to FIG. 5, one embodiment of the invention includes vacuum hold down zones 602, which may include substantially image free areas or strips located along the edges of liquid image bearing member 12, extending in the process direction. As indicated, the hold down zones 602 will preferably be undeveloped and continuous regions containing little or no toner and/or liquid carrier. During operation, zones 602 will be pulled quickly into contact with the surface of blotting member 56, and clamped by the full force of the vacuum level being applied, causing the hold down zone to have a motion which corresponds to that of blotter roll 56. Those skilled in the art will recognize that numerous other vacuum edge clamping means may be employed, as long the inboard and outboard edges of liquid image bearing member 12 are attached to blotting member 56 during operation. In another embodiment of the invention, zones 602 may be formed by extending the imaging member in inboard and outboard directions beyond the width of the development subsystem. In still another embodiment, vacuum hold down zones 602 may be created by placing separate vacuum ports on just on the blotting member just inside its inboard and outboard edges.

While excess pressure exerted upon the image surface is undesirable since it may harm or even destroy the image, that is not the case with respect to the area of vacuum hold down zones 602. Thus if desired, any appropriate device may be used to push or urge liquid bearing member 12 and blotting member 56 into contact. Devices such as springs, flexible fingers, stationary vacuum shoes, or other suitable means 504 may be used to align and urge the imaging member and the blotting member into initial contact as indicated in FIG. 4.

Figure 6:
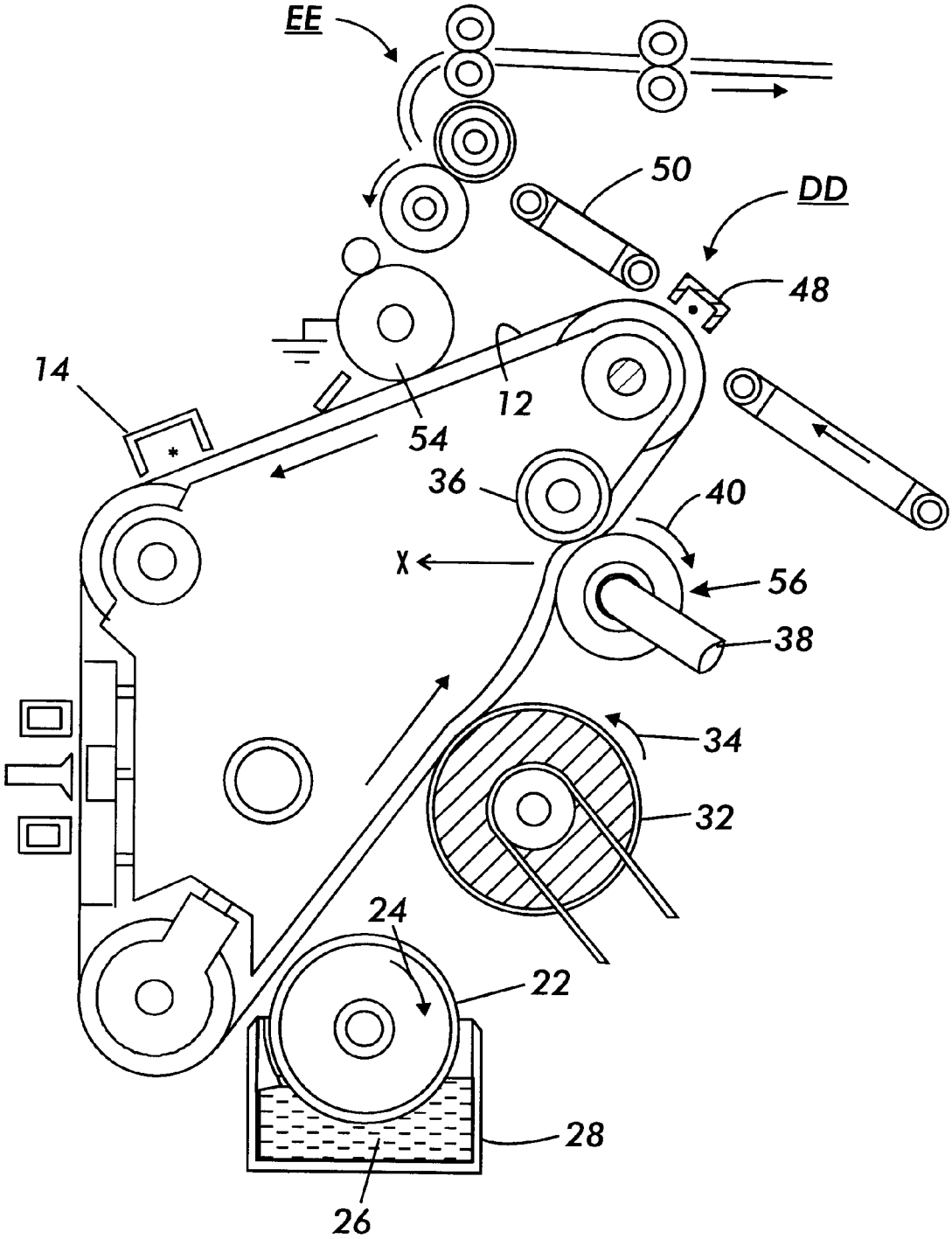
FIG. 6 is a schematic view of an electrophotographic reproduction machine as shown in FIG. 1 incorporating the present invention.

One example of the manner in which the present invention may be implemented include printing systems such as those shown in FIG. 6. As noted earlier, the invention has been described thus far in conjunction with a belt-type imaging member and a rigid cylindrical blotter roll, those skilled in the art will appreciate that the improved blotting action created by the present invention can be straightforwardly adapted to the case of a cylindrical image-bearing member and a flexible blotter member, as well as other conceivable combinations. As previously indicated, the present invention merely requires either one or both of these members to be made from a flexible material.

Referring to FIG. 6, the printer of FIG. 1 may be altered as illustrated to include the present invention. As shown, blotting member 56 and the associated vacuum 38 are pushed toward the inside of the loop defined by liquid image bearing member 12 in the direction of arrow x. Locating roll 56 and vacuum 38 in this manner causes liquid image bearing member 12 to move around the circumference of the roll. In the preferred embodiment, liquid image bearing member 12 will remain in contact with blotting member 56, conforming to its shape as it the belt is transported through the path.

It is, therefore, apparent that there has been provided in accordance with the present invention, a method and apparatus for high speed reproduction of images developed using a liquid developer material that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for removing excess liquid from a liquid bearing member, comprising:

a) a blotting member placed in relative motion with respect to the liquid bearing member, said blotting member having an interior core surrounded by a conformable, porous exterior surface, said interior core being under a vacuum, said vacuum having a level that is lower than a capillary pressure of said porous exterior surface;

b) at least one guide which brings the liquid bearing member and said blotting member into conformable contact under a force primarily applied by said interior core vacuum, thereby forming a contacting region in relative motion to said blotting member; and c) a securing device which maintains the liquid bearing member and said blotting member in a relationship to cause liquid to be drawn from the liquid bearing member and absorbed by said blotting member wherein a liquid borne by the liquid bearing member includes a xerographic image that has been developed by solid toner particles immersed in a liquid carrier medium wherein said guide further comprises at least one slack provider, in close proximity to said contacting region, which provides a slack region in at least one of said flexible members, thereby enabling said contacting region to be maintained.

2. An apparatus for removing excess liquid as claimed in claim 1 wherein said slack provider further comprises:

a) a position sensor which senses a size of said slack region;

b) a driving device which varies a speed differential between the liquid bearing member and said blotting member as said contacting region is formed; and c) a feedback system which links said position sensor to said adjustable driving device to maintain said slack region size.

3. An apparatus for removing excess liquid from a liquid bearing member, comprising:

a) a blotting member placed in relative motion with respect to the liquid bearing member, said blotting member having an interior core surrounded by a conformable, porous exterior surface, said interior core being under a vacuum, said vacuum having a level that is lower than a capillary pressure of said porous exterior surface;

b) at least one guide which brings the liquid bearing member and said blotting member into conformable contact under a force primarily applied by said interior core vacuum, thereby forming a contacting region in relative motion to said blotting member; and c) a securing device which maintains the liquid bearing member and said blotting member in a relationship to cause liquid to be drawn from the liquid bearing member and absorbed by said blotting member wherein a liquid borne by the liquid bearing member includes a xerographic image that has been developed by solid toner particles immersed in a liquid carrier medium wherein said securing device applies a force to the liquid bearing member outside a perimeter of said xerographic image, while preventing an application of said force within said perimeter.

4. An apparatus for removing excess liquid from a liquid bearing member, comprising:

a) a blotting member placed in relative motion with respect to the liquid bearing member, said blotting member having an interior core surrounded by a conformable, porous exterior surface, said interior core being under a vacuum, said vacuum having a level that is lower than a capillary pressure of said porous exterior surface;

b) at least one guide which brings the liquid bearing member and said blotting member into conformable contact under a force primarily applied by said interior core vacuum, thereby forming a contacting region in relative motion to said blotting member; and c) a securing device which maintains the liquid bearing member and said blotting member in a relationship to cause liquid to be drawn from the liquid bearing member and absorbed by said blotting member wherein a liquid borne by the liquid bearing member includes a xerographic image that has been developed by solid toner particles immersed in a liquid carrier medium wherein at least one of the liquid bearing member and said blotting member is flexible wherein said securing device further comprises at least one vacuum hold-down zone having a motion which corresponds to that of said contacting region.

5. An apparatus for removing excess liquid as claimed in claim 4 wherein said vacuum hold-down zone further comprises a substantially liquid-free area located along an edge of said image bearing member, parallel to a process direction of said image bearing member, and in pressure contact with said blotting member.

6. A method of removing excess liquid from a liquid bearing member, comprising:

a) bringing the liquid bearing member into conformable contact with a blotting member, said blotting member having an interior core surrounded by a conformable, porous exterior surface, said interior core being under a vacuum having a level lower than a capillary pressure of said porous exterior surface, wherein the liquid bearing member and said blotting member are brought into conformable contact under a force primarily applied by said interior core vacuum to form a contacting region; and b) maintaining the liquid bearing member and said blotting member in non-sliding relationship, thereby causing liquid to be drawn from the liquid bearing member and absorbed by said blotting member wherein a liquid borne by the liquid bearing member includes a xerographic image that has been developed by solid toner particles immersed in a liquid carrier medium wherein said bringing step further comprises providing a slack region in at least one of said flexible members in close proximity to said contacting region.

7. A method of removing excess liquid as claimed in claim 6 wherein said slack providing step further comprises:

a) sensing a size of said slack region;

b) varying a speed differential between the liquid bearing member and said blotting member as said contacting region is formed; and c) maintaining said slack region size by conducting said varying step in response to said sensing step.

8. A method of removing excess liquid from a liquid bearing member, comprising:

a) bringing the liquid bearing member into conformable contact with a blotting member, said blotting member having an interior core surrounded by a conformable, porous exterior surface, said interior core being under a vacuum having a level lower than a capillary pressure of said porous exterior surface, wherein the liquid bearing member and said blotting member are brought into conformable contact under a force primarily applied by said interior core vacuum to form a contacting region; and b) maintaining the liquid bearing member and said blotting member in a relationship, thereby causing liquid to be drawn from the liquid bearing member and absorbed by said blotting member wherein a liquid borne by the liquid bearing member includes a xerographic image that has been developed by solid toner particles immersed in a liquid carrier medium wherein said maintaining step further comprises applying a force to the liquid bearing member outside a perimeter of said xerographic image without applying said force within said perimeter.

9. A method of removing excess liquid as claimed in claim 8 wherein said maintaining step further comprises urging the liquid bearing member against said blotting member.

10. An method of removing excess liquid according to claim 9 wherein said vacuum hold-down zone further comprises a substantially liquid-free area located along an edge of said image bearing member, outside an image supporting area, and parallel to a process direction of said liquid bearing member, and in pressure contact with said blotting member outside said image supporting member.

11. A method of removing excess liquid according to claim 8 wherein said maintaining step further comprises forming at least one vacuum hold-down zone which has a motion corresponding to that of said contacting region.

12. An apparatus for removing excess liquid from a liquid-developed electrostatographic image comprising:

a) an image bearing member which supports the developed electrostatographic image and transports it along a path in a process direction;

b) a blotting member having a conformable, porous face and having a vacuum level below a capillary pressure of said porous face;

c) means for guiding said image bearing member and said blotting member into face to face contact throughout a length while preventing forces other than said vacuum blotter forces to be applied to the electrostatoaraphic image; and d) means for maintaining said image bearing member and said blotting member in a relationship for a time period sufficient to remove excess liquid from said image, thereby strengthening the electrostatographic image without disturbing it wherein at least said image bearing member is in the form of a flexible belt wherein said guiding means further comprises at least one slack providing means to provide a slack region in at least one said belt.

13. An apparatus for removing excess liquid according to claim 12 wherein said slack providing means further comprises:

a) position sensing means to determine a size of said slack region;

b) adjustable driving means to vary a speed at which said image bearing member and said blotting member are brought into contact; and c) feedback means linking said position sensing means to said adjustable driving means, thereby maintaining said slack region size.

14. An apparatus for removing excess liquid from a liquid-developed electrostatographic image comprising:

a) an image bearing member which supports the developed electrostatographic image and transports it along a path in a process direction;

b) a blotting member having a conformable, porous face and having a vacuum level below a capillary pressure of said porous face;

c) means for guiding said image bearing member and said blotting member into face to face contact throughout a length while preventing forces other than said vacuum blotter forces to be applied to the electrostatographic image; and d) means for maintaining said image bearing member and said blotting member in a relationship for a time period sufficient to remove excess liquid from said image, thereby strengthening the electrostatographic image without disturbing it wherein said maintaining means further comprises at least one vacuum hold-down zone which moves with said contacting length in order to secure said image bearing member and said blotting member in substantially non-sliding relationship.

15. An apparatus for removing excess liquid according to claim 14 wherein said vacuum hold-down zone further comprises a substantially image-free strip located along an edge of said image bearing member, parallel to said process direction, and in pressure contact with said blotting member.

* * * * *